United States Patent [19]

Baumgärtner

[11] Patent Number: 4,775,243

[45] Date of Patent: Oct. 4, 1988

[54] MIXING AND KNEADING APPARATUS

[75] Inventor: Siegfried Baumgärtner, Munich, Fed. Rep. of Germany

[73] Assignee: Krauss-Maffei A.G., Fed. Rep. of Germany

[21] Appl. No.: 923,591

[22] Filed: Oct. 27, 1986

[30] Foreign Application Priority Data

Oct. 25, 1985 [DE] Fed. Rep. of Germany ..... 3538070

[51] Int. Cl.[4] ..... B01F 7/04

[52] U.S. Cl. ..... 366/303; 241/243; 366/312; 366/313

[58] Field of Search ..... 366/302, 303, 304, 307, 366/309, 311, 312, 315, 317, 325, 99; 241/243, 228; 99/348

[56] References Cited

U.S. PATENT DOCUMENTS

| | | | |
|---|---|---|---|
| 1,585,169 | 5/1926 | Perkins | 366/303 |
| 3,182,633 | 5/1965 | Lodige | 366/307 |
| 3,197,180 | 7/1965 | Bates | 366/303 |
| 3,880,407 | 4/1975 | List | 366/99 |
| 4,169,680 | 10/1979 | Littlefield . | |
| 4,310,124 | 1/1982 | Schwing | 366/303 |
| 4,413,790 | 11/1983 | Lipp . | |

FOREIGN PATENT DOCUMENTS

| | | |
|---|---|---|
| 107726 | 11/1960 | Czechoslovakia . |
| 1922983 | 5/1969 | Fed. Rep. of Germany . |
| 2349106 | 1/1983 | Fed. Rep. of Germany . |
| 3037332 | 9/1983 | Fed. Rep. of Germany . |

*Primary Examiner*—Robert W. Jenkins

*Attorney, Agent, or Firm*—Robert J. Koch

[57] ABSTRACT

A mixing and kneading apparatus with a kneading shaft bearingly supported in a cylindrical housing, a plurality of disk elements mounted perpendicularly and axially spaced apart on the kneading shaft. The disk elements carry scraper edges arranged essentially transversely to the plane of the disk elements and facing the housing wall at a slight distance. The housing wall, the kneading shaft, and the disk elements are optionally heatable or and coolable. In order to obtain an intensive intermixing and a uniform retention time of all of the product particle present in the toroidal reaction space, at least one mixer arm connected to the housing or the kneading shaft projects into the toroidal space to a distance at least in the vicinity of the axial and radial center of the toroidal cross section between two axially adjacent disk elements. The mixing arm applies a mixing and/or transport action onto the goods or products present between the inner wall of the housing and the kneading shaft.

16 Claims, 2 Drawing Sheets

FIG. 2
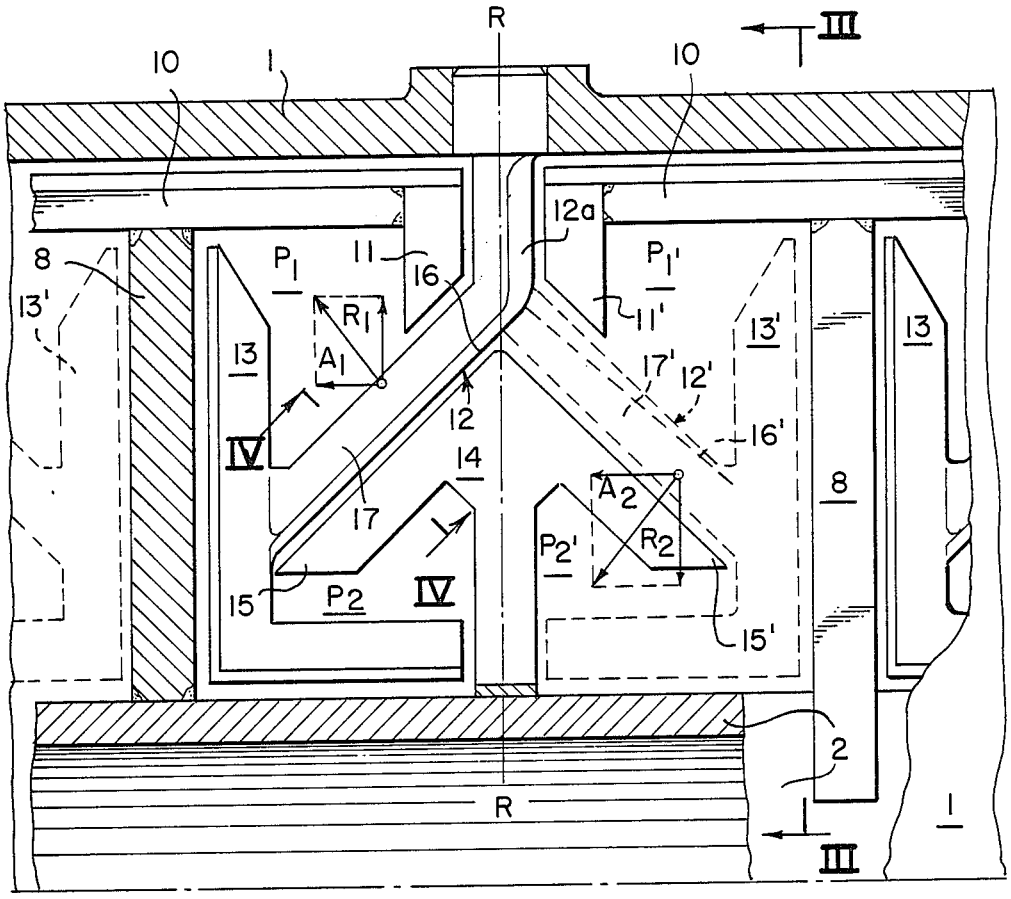
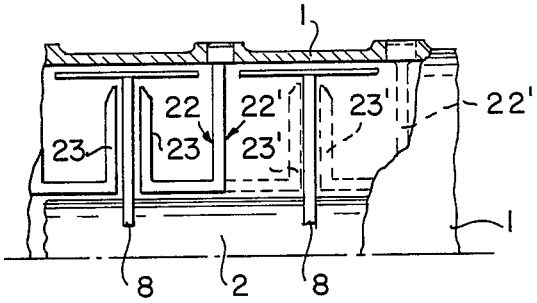
FIG. 5

MIXING AND KNEADING APPARATUS

BACKGROUND OF THE INVENTION

1. Field of the Invention

The invention concerns a mixing and kneading apparatus and more particularly to an apparatus for mechanical, chemical, and thermal treatment of materials.

2. Description of the Related Technology

A mixing and kneading apparatus of the type shown in No. DE-2 349 106, corresponding to U.S. Pat. No. 3,880,407 exhibits a toroidal annular space formed between two adjacent disks defined by the disks, a housing and the shaft, and covered only in boundary areas by hooked-shaped kneading and scraping elements fixedly mounted on the housing. The mixing of the product within the toroidal element is not assured. This may lead to inadequate product homogeneity.

A further disadvantage is that product residues remain inside the toroidal space and cannot be discharged. Newly introduced product to be treated in the reactor may thereby be damaged. Therefore undesirable product mixes between the raw and the finished product may occur in a product change over.

SUMMARY OF THE INVENTION

It is therefore an object of the invention to obtain an intensive mixing of the different product components in the entire product or reaction space together with a uniform retention time of the product particles present in the reaction space.

This object is attained according to the invention by a mixing apparatus with a kneading shaft bearingly supported in a cylindrical housing, with a plurality of disk elements mounted axially spaced apart on and perpendicularly to said kneading shaft and carrying a plurality of scraper edges arranged essentially transverse to the plane of the disk elements and facing the housing wall at a small distance. The housing wall, the kneading shaft and the disk elements are optionally heatable and/or coolable. The surface of a kneading shaft and the walls of two axially disk elements, at least one mixer arm projects into a toroidal space included between the inner wall of the housing extending at least in the vicinity of the axial and radial center of the cross section of the toroidal space. The apparatus applies a mixing and/or transport action to the goods located therein. An apparatus according to the invention avoids dead zones and uninvolved product spaces, and assures a continuous axial product transport. The layout of the plowshare-like baffle surfaces further insures that the product masses revolving in the central area of the toroidal space are continuously rearranged and moved toward the heatable and coolable housing and kneading shaft surfaces.

The transport components are variable in an arbitrary manner by the twisted configuration of the cutting edge and the baffle surface along the preferably diagonal mixer arm. A steeper slope may be provided in the vicinity of the kneading shaft in order to obtain adequate transport components in the radial and axial directions even in view of the lower peripheral velocity of the product flow prevailing in this area.

A particularly effective penetration of a toroidal space by the mixer arms is obtained on a layout of several mixer arms protruding into the toroidal space, their diagonal directions are arranged in a mirror image alternating with respect to a radial axis R-R.

The baffle surfaces of the cross sectional profiles of two mixer arms diagonally offet in a mirror image layout have a configuration such that both baffle surfaces provide diverting components of the product flow in the same axial direction and in opposite radial directions in order to obtain a strong axial transport component and good contact with the heatable surfaces of the hounding and the kneading shaft.

In a preferred embodiment, accessory or auxiliary mixer arms, mounted on kneading shaft, project into the radially inner product space and serve to additionally rearrange and mix the product in this area. Advantageously, the accessory mixer arm is provided with shearing edges associated in a parallel manner with the diagonal mixer arms in a shearing gap, whereby the product is exposed to intensive shearing and squeezing.

The accessory or auxiliary mixer arm may carry one or two shearing edges travelling alternatingly past the diagonally, mirror image-like offset mixer arms.

An L-shaped scraper is mounted on the mixer arm fixedly attached to the housing to continuously clean the surfaces of the disk elements and the kneading shaft. One leg of the scraper scraping the disk element and the other the kneading shaft.

Radially inwardly directed agitators are arranged on the ends of the scraping edges to clean the radially projecting part of the mixer arm, which also contribute to the mixing the the radially outer product space. In addition to the scraping and cleaning effect, the agitators provide together with the vertically mounted part of the mixer arm an intensive mixing of the product in this area.

An example of the invention will be apparent in more detail, described hereinafter with reference to the drawings.

BRIEF DESCRIPTION OF THE DRAWINGS

In the drawings:

FIG. 2 shows the partial area broken open of FIG. 1 enlarged.

FIG. 5 shows a further embodiment of a mixing and kneading apparatus with part of the housing broken open.

DETAILED DESCRIPTION OF THE PREFERRED EMBODIMENT

Figure 1:
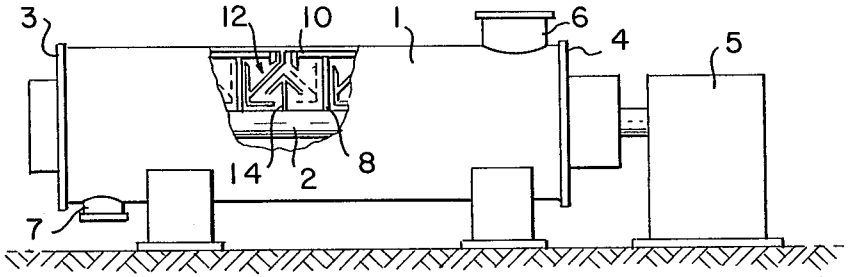
FIG. 1 shows a mixing and kneading apparatus with a partial area of the housing broken open.

FIG. 1 shows a mixing and kneading apparatus with a kneading shaft 2 arranged coaxially in a cylindrical housing and bearingly supported in the frontal walls 3 and 4. The kneading shaft 2 passes through the frontal wall 4 and is coupled with a drive assembly 5. A filler opening 6 is located in the frontal wall 4, togehter with an outlet opening 7 in the frontal wall 3.

To facilitate control of conditions within the reaction or mixing chamber the housing wall, kneading shaft 2, or disk elements 8 may be heated or cooled.

Figure 3:
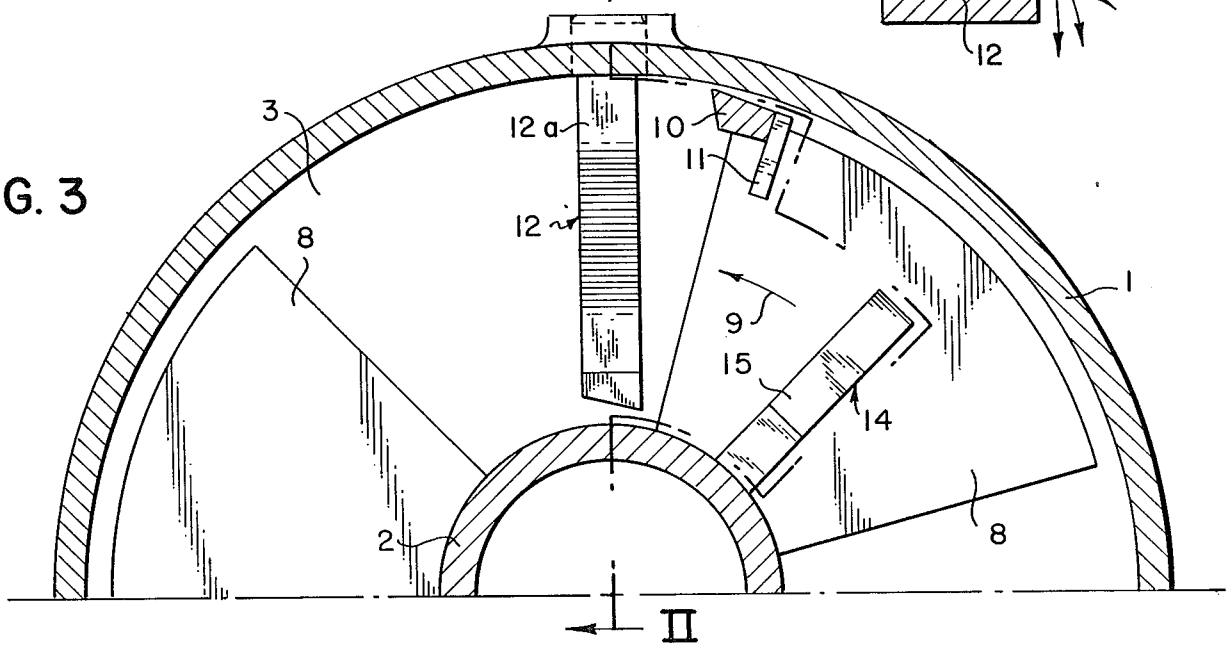
FIG. 3 shows a section through a part of the mixing and kneading apparatus on the line III—III of FIG. 2.

The cylindrical housing 1 shown is broken open in a central partial area in order to display the kneading shaft 2 and other functional elements, which appear more clearly in FIGS. 2 to 4, described below.

FIG. 2 shows the housing 1 with the kneading shaft 2 supported therein and with the disk elements 8 placed on said kneading shaft in planes perpendicular to the axes of the shaft and the housing and extending to the inner wall of the housing while forming a gap. As seen in FIG. 3, the disk elements 8 have surfaces corresponding to a sector of 60°. Three disk elements 8 are always arranged in one plane offset by 120°.

Arrow 9 (FIG. 3) indicates the direction of rotation. The radially outer forward edges of the disk elements 8 carry transverse scraping edges 10. The scraping edges 10 may be arranged at an angle to an axial generating line of the housing and define a scraping gap with the inner wall of the housing. The scraping edges 10 carry radially inward directed agitators 11 at their ends.

A mixer arm 12 is mounted centrally between two planes of disk elements 8 in the housing wall. The mixer arm has a first part **12*a* is directed radially inward and exhibits a dog leg at an angle of 45° relative to the disk element 8 located in the left side in FIG. 2. A further mixer arm 12', shown by broken lines in FIG. 2, is angled toward the right hand disk element 8** and represents the mixer arm following in peripheral direction; for the sake of clarity it is pivoted into the image plane of FIG. 2. Preferably, two mixer arms are provided, offset by 180° in the peripheral direction, with alternating angled directions.

The mixer arms 12, 12' are equipped with L-shaped scrapers 13, 13' at their ends. One of each scraper is associated with the surface of the disk elements 8 and the other leg with the surface of the kneading shaft 2.

The angled mixer arms 12, 12' divide the toroidal space included by the inner surface of the housing 1, the kneading shaft 2 and the axially adjacent disk elements 8, into a radially outer product space $P_1$, $P_2'$ and a radially inner product space $P_2$, $P_2'$.

The kneading shaft 2 exhibits several, preferably two mixer arms 14 intended for use as auxiliary mixer arms. The auxiliary mixer arms 14 are mounted between two axially adjacent disk elements 8 and equipped with shearing edges 15, 15' spaced apart from and parallel to the mixer arms 12, 12' diagonally projecting into the toroidal space.

Figure 4:
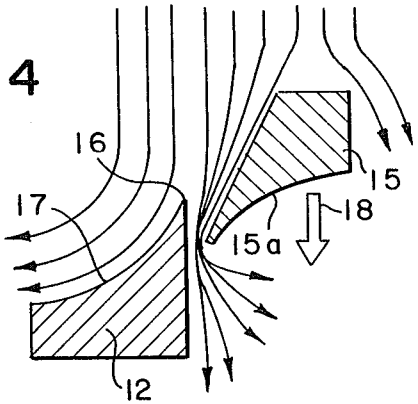
FIG. 4 shows a section through a mixer arm and a shearing edge on the line IV—IV in FIG. 2.

FIG. 4 shows the cross sectional surfaces of a mixer arm 12 and a shearing edge 15 exposed to a product stream flowing in the peripheral direction. The product stream is divided by a cutting edge 16 provided on the mixer arm 12 and diverted into a subsequent baffle surface 17. The product stream flowing by the other side of the cutting edge is intercepted by the shearing edge 15 and subjected during its passage (arrow 18) along the stationary mixer arm 12 to an intensive squeezing and shearing action. An additional diversion may be obtained by providing a baffle surface **15*a*. It is possible thereby to affect the flow effects caused by the mixer arm 12, 12'** as desired.

The cutting edge 16 extends in a straight line on the mixer arm 12 shown in FIG. 2 by a solid line, with the baffle surface 17 located in the radially outer area, whereby the product stream impacting the mixer arm 12 is caused to undergo a diversion with a radially outward directed transport component $R_1$ and an axial transport component $A_1$ directed toward the left.

The cutting edge 16' extends in a curved configuration with the baffle surface 17' located in the radially inner area on the mixer arm 12' represented in FIG. 2 by broken lines. The product stream impacting the mixer arm 12' is diverted with a radially inward directed transport component $R_2$ and a transport component $A_2$ directed axially to the left.

The use of the cutting edge 16' curving with the baffle surface 17' results in product volumes which flow in the radially inner area with a lower peripheral velocity undergoing a more effective diversion compensating for the lower oncoming flow velocity.

In principle, the cutting edge 16' may also be curving with the baffle surface 17' in a manner such that the product stream impacting the mixer arm is diverted partially in the radially outward direction and axially to the right, and impart radially inward and axially to the left. Based on the fact that a mixer arm of this type divides the product stream into partial flows with opposing axial transport components, no uniform axial transport component defined in an axial outflow direction is established, so that a mixer arm with an S-shaped cutting edge and baffle surface is used overwhelmingly for intensive intermixing. It is advantageous to use mixer arms with differently oriented baffle surfaces in succession.

FIG. 5 shows, in solid lines, a further embodiment of a mixer arm 22 fastened to the housing 1 and extending between two adjacent disk elements 8 radially inward to the kneading shaft 2 and being angled off there into an L-shaped scraper 23, one leg of which is associated with the disk elements 8 and the other leg with the surface of the kneading shaft 2.

The mixer arm 22', shown in FIG. 5 by broken lines together with the L-shaped scraper 23', corresponds to a mirror image of the mixer arm 22 and its scraper 23 and is arranged in the housing in a manner offset by 180° in the image of plane of FIG. 5.

The radially extending mixer arm 22, 22' may also be equipped with a cutting edge and one or two baffle surfaces, whereby the revolving products may be diverted in the radial and/or axial transport direction, so that both a good flow onto the heated surfaces of the housing and the kneading shaft and a uniform axial transport of the product may be obtained.

The baffle surface may be curved over the radial extent of the mixer arm 22, 22' in the manner of a plowshare so that a slow component in the direction of the housing in the upper half and a flow component in the direction of the kneading shaft in the lower half are established, where a uniform axial flow component in the transport direction is present.

The mixing and kneading apparatuses described are especially suitable for continuous operations. An axial transport component is imparted to the product over the entire product space as axial components $A_1$ and $A_2$ act in the same direction. The product mass from all of the areas is seized, rearranged, and conducted to the heated or cooled surfaces of the housing, the kneading shaft and the disk elements in a steady flow.

The mixing and kneading apparatus according to the invention may also be used for a batch operation, by for example, providing only mixer arms 12, as shown in FIG. 2 by solid lines. In the process product masses from the center toroidal areas are taken constantly and transported with a radial component $R_1$ to the heated wall of the housing and with an axial component $A_1$ to the frontal wall 3 of the mixing and kneading apparatus. Upon the impact of the product stream on the frontal wall, it rolls over and flows back into the radially inner product area $P_2$, $P_2'$ associated with the kneading shaft, whereby the product is stream is intermixed further by the action of the mixer arms 14 in the form of auxiliary mixer arms and the scraper. The product is discharged advantageously through an outlet fitting (not shown) located in a radially inner area of the frontal wall 4.

I claim:

1. A mixing and kneading apparatus comprising:

a cylindrical housing;

an axially arranged kneading shaft bearingly supported within said housing;

a toroidal space defined between an inner housing wall and said kneading shaft;

a plurality of axially distributed disk elements mounted perpendicurlarly on said kneading shaft;

a scraper edge associated with each disc element connected essentially transverse to a plane of said disk elements facing a housing wall and at a small distance to said housing wall;

a mixer arm projecting inwardly from said housing wall between adjacent disk elements, said mixer arm comprising a baffle surface at an angle to said kneading shaft which divides said toroidal space into a radially outer product space and a radially inner product space and exhibiting a configuration adapted to apply an axially and/or radially directed transport action.

2. A mixing and kneading apparatus according to claim 1, wherein the mixer arm comprises a cutting edge.

3. A mixing and kneading apparatus according to claim 2, wherein said baffle surface is approximately diagonal to the kneading shaft and divides said toroidal space into an outer product space between said baffle and said housing wall, and an inner product space between said baffle and said kneading shaft and wherein the transport action applied by the baffle surface is directed axially and radially toward the inner or the outer product space.

4. A mixing and kneading apparatus according to claim 3, wherein the cutting edge and the baffle surface are curved along the mixer arm.

5. A mixing and kneading apparatus according to claim 4, further comprising a plurality of mixer arms projecting into the toroidal space with alternately directed diagonal portions.

6. A mixing and kneading apparatus according to claim 5, wherein baffle surfaces of adjacent mixer arms exhibit configurations such that product flow is diverted in the same axial direction and opposite radial directions.

7. A mixing and kneading apparatus according to claim 1 further comprising auxiliary mixer arms mounted on the kneading shaft and extending radially inward and exhibiting baffle surfaces set into opposing radial and uniform axial directions.

8. A mixing and kneading apparatus according to claim 7, wherein said mixer arms cooperate with shearing edges exhibited by said auxiliary mixing arms to define a shearing gap.

9. A mixing and kneading apparatus according to claim 8, further comprising an L-shaped scraper arranged on said mixer arm and exhibiting a first leg associated with a surface of a disk element and a second leg associated with a surface of said kneading shaft.

10. A mixing and kneading apparatus according to claim 9, wherein a scraper edge associated with a disc element further comprises an agitator directed radially toward said kneading shaft.

11. A mixing and kneading apparatus according to claim 10, wherein said mixer arm further comprises a first portion connected to and arranged perpendicularly with said housing wall and wherein said agitators are associated with said first portion and are configured to act as scrapers.

12. A mixing and kneading apparatus according to claim 11, wherein said scraper edge is arranged at an angle relative to an axis of said housing.

13. A mixing and kneading apparatus according to claim 1, further comprising an L-shaped scraper arranged on said mixer arm exhibiting a first leg associated with a surface of a disk element and a second leg associated with a surface of said kneading shaft.

14. A mixing and kneading apparatus according to claim 1, wherein a scraper edge associated with a disc element further comprises an agitator directed radially toward said kneading shaft.

15. A mixing and kneading apparatus according to claim 14, wherein said mixer arm further comprises a first portion connected to and arranged perpendicularly with said housing wall and wherein said agitators are associated with said first portion and are configured to act as scrapers.

16. A mixing and kneading apparatus according to claim 1, wherein said scraper edge is arranged at an angle relative to an axis of said housing.

* * * * *